US010837145B2

(12) United States Patent
Lanni

(10) Patent No.: US 10,837,145 B2
(45) Date of Patent: Nov. 17, 2020

(54) PAVING BLOCK UNITS AND PAVING BLOCK SYSTEM FOR FLUID STORAGE AND DRAINAGE ALLOWING VERTICAL AND HORIZONTAL FLOW OF FLUID

(71) Applicant: Steven T. Lanni, Houston, TX (US)

(72) Inventor: Steven T. Lanni, Houston, TX (US)

(73) Assignee: Steven T. Lanni, Houston, TX (US)

( * ) Notice: Subject to any disclaimer, the term of this patent is extended or adjusted under 35 U.S.C. 154(b) by 0 days.

(21) Appl. No.: 16/283,105

(22) Filed: Feb. 22, 2019

(65) Prior Publication Data

US 2019/0276988 A1 Sep. 12, 2019

Related U.S. Application Data

(60) Provisional application No. 62/639,403, filed on Mar. 6, 2018.

(51) Int. Cl.
*E01C 11/22* (2006.01)
*E01C 5/06* (2006.01)

(52) U.S. Cl.
CPC ..... *E01C 11/225* (2013.01); *E01C 5/06* (2013.01); *E01C 2201/02* (2013.01); *E01C 2201/20* (2013.01)

(58) Field of Classification Search
CPC ..... E01C 11/225; E01C 5/06; E01C 2201/02; E01C 2201/20; E01C 5/005; E01C 5/006; E01C 11/227; E01C 11/223; E01C 9/004
See application file for complete search history.

(56) References Cited

U.S. PATENT DOCUMENTS 3,732,020 A * 5/1973 Judge ..... E01C 5/20 404/19
5,281,048 A * 1/1994 Hagenah ..... E01C 5/065 404/44
5,400,561 A * 3/1995 Metten ..... B28B 11/04 52/606
5,405,211 A * 4/1995 Halwani ..... C04B 28/021 106/805
5,484,230 A * 1/1996 Rudloff ..... E02B 3/123 404/35
5,496,129 A * 3/1996 Dube ..... E01C 5/06 404/29
5,797,698 A 8/1998 Barth et al.
6,939,077 B1 9/2005 Hart
7,425,106 B2 * 9/2008 Altmann ..... E01C 5/06 404/17
8,251,607 B2 8/2012 Buch
8,459,896 B2 6/2013 Buch
(Continued)

FOREIGN PATENT DOCUMENTS

JP 06322708 A * 11/1994 ..... E01C 11/225

*Primary Examiner* — Abigail A Risic
(74) *Attorney, Agent, or Firm* — Patterson + Sheridan, LLP

(57) ABSTRACT

A paving block system comprising a plurality of paving block units (A) and a plurality of paving block units (B) interlocked together to form a paving block system. The paving block units each comprise at least two channels formed along a bottom face of the paving block units. The channels of the paving block units (A) are in fluid communication with the channels of the paving block units (B) when the paving block units are interlocked together to form the paving block system configured for storage and/or drainage of fluid.

20 Claims, 10 Drawing Sheets

(56) References Cited

U.S. PATENT DOCUMENTS

| | | | | |
|---|---|---|---|---|
| 2004/0250495 | A1* | 12/2004 | Manthei | E01C 5/06 52/589.1 |
| 2005/0066607 | A1* | 3/2005 | Hagenah | E01C 5/06 52/596 |
| 2009/0180833 | A1* | 7/2009 | Buch | E01C 11/225 404/34 |
| 2009/0274514 | A1* | 11/2009 | Scheiwiller | E01C 9/004 404/42 |
| 2012/0141202 | A1* | 6/2012 | Buch | E01C 5/00 404/41 |
| 2014/0169878 | A1* | 6/2014 | MacDonald | E01C 5/003 404/41 |
| 2014/0199121 | A1* | 7/2014 | Brunkhorst | E01C 11/265 404/73 |
| 2016/0010288 | A1* | 1/2016 | Castonguay | B44C 1/28 404/41 |
| 2016/0032539 | A1* | 2/2016 | Buch | E01C 5/06 404/3 |
| 2017/0174875 | A1* | 6/2017 | Bertrand | C08L 9/06 |
| 2019/0217498 | A1* | 7/2019 | Riccobene, Jr. | B28B 7/007 |
| 2019/0352857 | A1* | 11/2019 | Siao | E01C 9/004 |

* cited by examiner

PAVING BLOCK UNITS AND PAVING BLOCK SYSTEM FOR FLUID STORAGE AND DRAINAGE ALLOWING VERTICAL AND HORIZONTAL FLOW OF FLUID

BACKGROUND

Field

Embodiments of the disclosure include paving block units that are able to be set adjacent to one another to create a paving block system for fluid storage and drainage that allows both vertical and horizontal flow of fluid.

Description of the Related Art

In urbanized areas, significant portions of land are paved over for roads, buildings, or other structures. In areas with high population a large percentage of ground space is being paved which leads to problems with controlling storm water drainage and raises issues with flash flooding.

Various methods of controlling storm water have been employed in the past. Most commonly utilized in the past has been a sewer system with water being directed into the sewer by various mechanical means. Additionally, various mechanisms known to persons having ordinary skill in the art have been employed, including but not limited to: detention ponds, retention ponds, holding ponds, and the like.

Most recently construction regulations have established that a specific percentage of land must be maintained as "green space", i.e. unpaved ground which can allow water to drain. Further, many localities may require water detention or retention capabilities of a specified volume. Some installations may maintain underground fluid.

More importantly, as such may cities and counties have recently employed "non-permeable" lot and/or parcel area calculation whereby a developer is not allowed to build over a certain percentage of land using a "permeable" surface such as foundation, concrete, walks, parking etc. In most cities and counties it is found that a "permeable" surface is accepted as such to greatly reduce its calculation in respect to normal "non-permeable" paving surfaces. In most instances this allows the builder to increase is buildable footprint size, and to virtually eliminate an expensive "retention pond" when normally necessary. This most cases this increases the developers profit, and allows the developer to increase its project size.

While some such systems exist in the art (such as U.S. Pat. Nos. 5,797,698; 6,939,077; 8,459,896; and 8,251,607), various disadvantages limit the efficacy of such systems. Such systems are difficult to clean and maintain, and are often dependent upon drainage characteristics of the aggregate foundation and soil beneath. Some soil characteristics allow little or virtually no drainage vertically into the soil. In the greater Houston area by way of example, the soil is almost all comprised of clay "gumbo" where very little fluid infiltrates and penetrates into the soil below. In these areas many cities and counties now require a secondary pump system to be employed to move the standing water. Without a secondary pump these systems would otherwise create stagnant pockets of fluid that can allow for undesirable bacteria and mosquitoes to collect and breed, thereby creating a health hazard.

It is desirable, therefore to provide a system and apparatus that can allow for fluid storage and drainage in any direction, whether a horizontal plane or a vertical plane, and eliminate standing stagnant water prevalent on standard paving block systems that restrict horizontal fluid flow.

SUMMARY

In one embodiment, a paving block system comprises a plurality of paving block units (A) and a plurality of paving block units (B) each comprising at least two channels formed along a bottom face of the paving block units, wherein the channels of the paving block units (A) are in fluid communication with the channels of the paving block units (B) when the paving block units are interlocked together to form the paving block system, wherein each paving block unit further comprises a plurality of spacers located on one or more sides of the paving block units to create voids between adjacent paving block units when the paving block units are interlocked together to allow fluid to flow freely along a vertical plane down the voids into the channels and notches, and wherein the channels and notches are in fluid communication with each other to allow fluid to flow freely along a horizontal plane beneath the paving block units when interlocked together.

In one embodiment, a paving block system comprises a plurality of paving block units (A) and a plurality of paving block units (B) each comprising at least two channels formed along a bottom face of the paving block units and a notch that provides cross flow between the channels, wherein each paving block unit further comprises a plurality of spacers located on one or more sides of the paving block units to create voids between adjacent paving block units when the paving block units are interlocked together to allow fluid to flow freely along a vertical plane down the voids into the channels and notches, wherein the spacers on the paving block unit (A) are located on the same relative sides as the spacers on the paving block unit (B), and wherein the channels and notches are in fluid communication with each other to allow fluid to flow freely along a horizontal plane beneath the paving block units when interlocked together.

In one embodiment, a paving block system comprises a plurality of paving block units each comprising at least two channels formed along a bottom face of the paving block units and a notch that provides cross flow between the channels, wherein each paving block unit further comprises a plurality of spacers located on one or more sides of the paving block units to create voids between adjacent paving block units when the paving block units are interlocked together to allow fluid to flow into the channels and notches, and wherein the channels and notches are in fluid communication with each other to allow fluid to flow beneath the paving block units when interlocked together for storage and drainage of fluid.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The embodiments disclosed herein relate to paving block units and a paving block system for fluid storage and drainage that allows for both vertical and horizontal flow of fluid, such as water. The paving block units and the paving block system as disclosed herein provide at least three (3) primary advantages over current paving block systems. First, the paving block units and the paving block system as disclosed herein are truly interlocking, in that the paving block units securely interlock with each other to form the paving block system without the need of any additional securing mechanism, such as cables. Second, the paving block units and the paving block system as disclosed herein allow both vertical and horizontal fluid flow, in that fluid can flow vertically down between adjacent paving block units and then flow horizontally across the surface beneath the paving block units to prevent stagnate pockets of fluid from forming. The fluid may flow in a continuous, unobstructed motion from vertical flow to horizontal flow. Third, the paving block units and the paving block system as disclosed herein provide an increased fluid penetration rate comparted to that of current paving block systems, in that the paving block units have an increased circumference area than current paving block units and about a ¼ inch spacing (e.g. a void) between adjacent paving block units that can result in an increased amount of fluid that can penetrate through the paving block system to maximize its rate of infiltration.

In one embodiment, a paving block system comprises one or more paving block units (A) configured to be interlocked with one or more paving block units (B), which when interlocked allows for both vertical and horizontal fluid flow. The paving block system prevents stagnant pockets of fluid from forming beneath the paving block system by allowing horizontal fluid flow in any direction. A secondary drainage system can be used along one or more edges of the paving block system to further remove the fluid.

Figure 1:
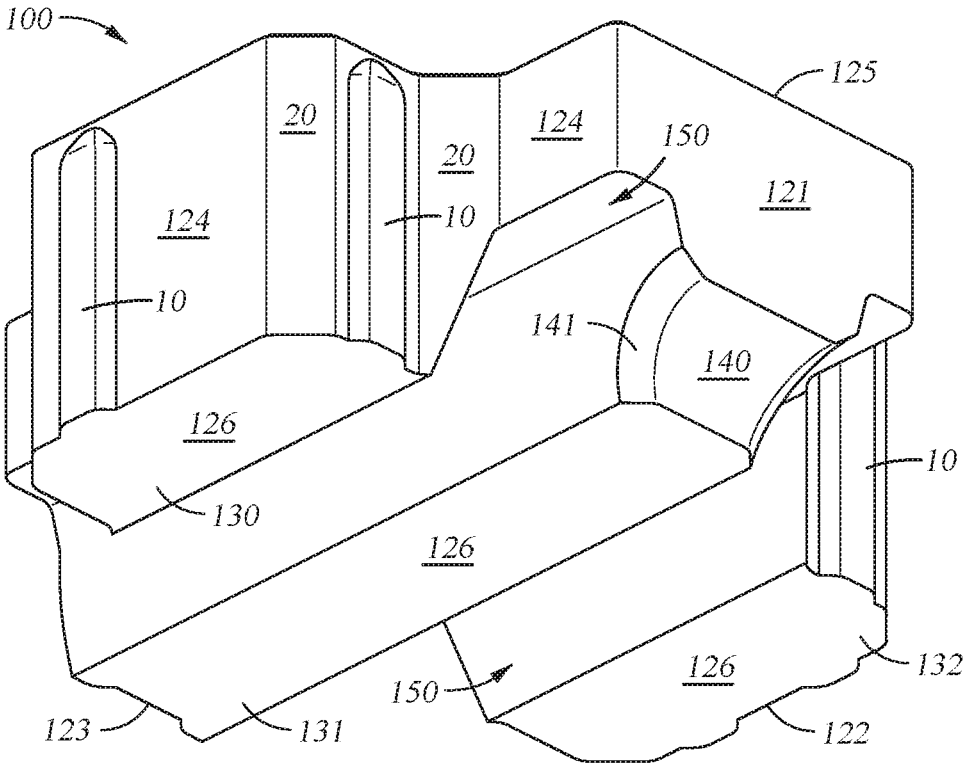
FIG. 1 is an isometric view of an embodiment of a paving block unit (A).

FIG. 1 is an isometric image of an embodiment of a paving block unit (A) 100. The paving block unit (A) 100 generally has a "cross" shape. The paving block unit (A) 100 comprises a front face 121 that extends from a left face 124 to a right face 122. The right face 122 extends from the front face 121 to a rear face 123. The rear face 123 extends from the right face 122 to the left face 124. The left face 124 extends from the rear face 123 to the front face 121. The paving block unit (A) 100 further comprises a top face 125 and a bottom face 126. A pair of horizontal channels 150 are formed along the bottom face 126, which separate the bottom face 126 into a left member 130, a middle member 131, and a right member 132. A notch 140 having rounded edges 141 is formed along the edge of the middle member 131 where the front face 121 intersects the bottom face 126. Several spacers 10 are located along the sides of the paving block unit (A) 100 and are described in more detail below.

The left member 130, the middle member 131, and the right member 132 extend from the bottom face 126 orthogonally towards the top face 125. The left member 130, the middle member 131, and the right member 132 together form a plurality of support members that are arranged to allow the paving block unit (A) 100 to be placed upon the ground or upon a foundation such that the top face 125 of the paving block unit (A) 100 lies in a substantially horizontal plane.

Figure 2A:
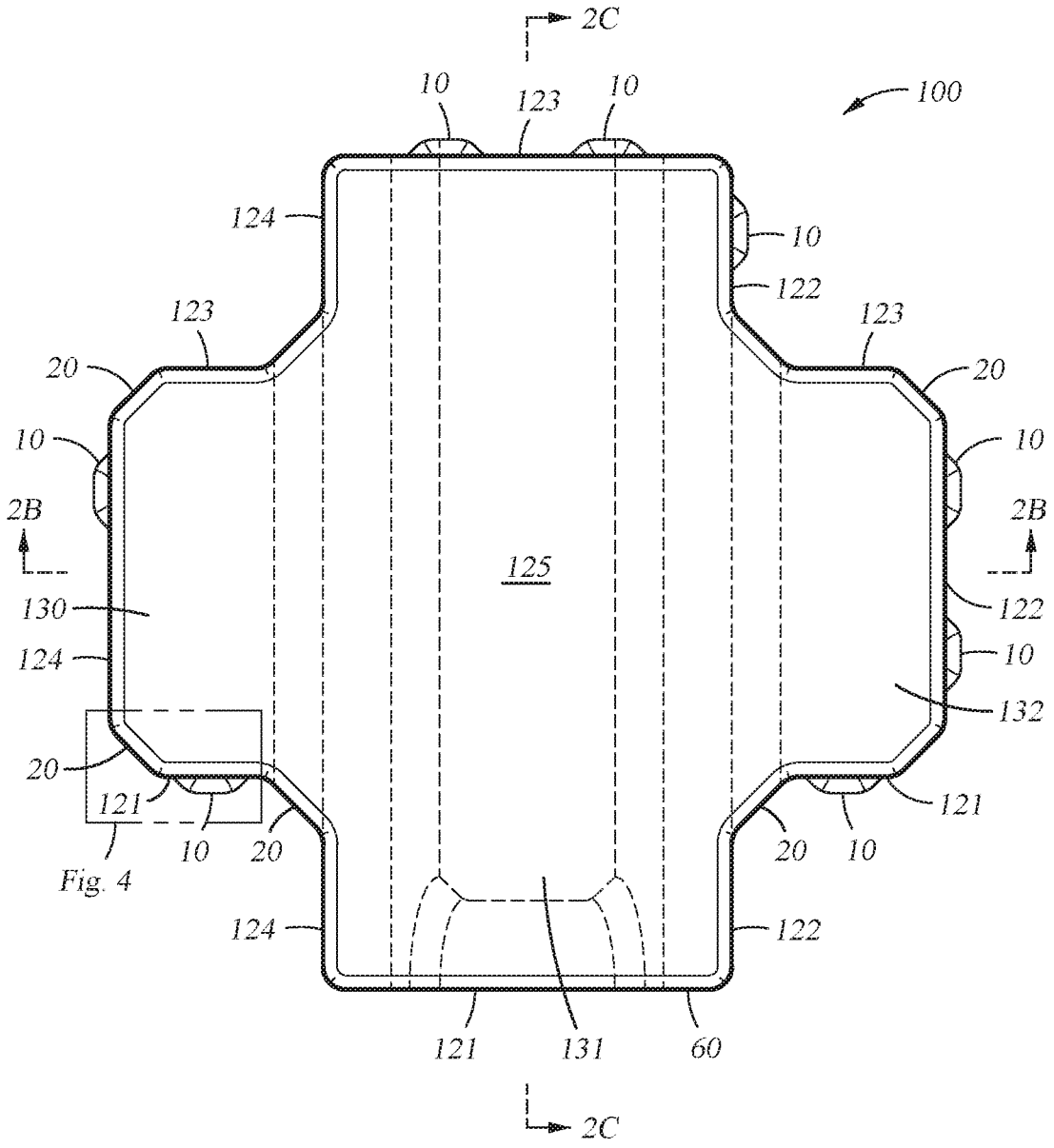
FIG. 2A is a top view of the paving block unit (A).

FIG. 2A is a top view of the paving block unit (A) 100. FIG. 2A better illustrates the "cross" shape of the paving block unit (A) 100. The paving block unit (A) 100 further comprises a plurality beveled edges 20. The beveled edges 20 can be of any angle. In other embodiments the edges 20 can be rounded. The beveled edges 20 at the corners allow the paving block unit (A) 100 to properly mate with adjacent paving block units.

One of the beveled edges 20 is positioned along the edge that intersects the left face 124 and rear face 123 of the left member 130. Another beveled edge 20 is positioned along the edge that intersects the rear face 123 of the left member 130 and the left face 124 of the middle member 131. Another beveled edge 20 is positioned along the edge that intersects the left face 124 and the front face 121 of the left member 130. Another beveled edge 20 is positioned along the edge that intersects the front face 121 of the left member 130 and the left face 124 of the middle member 131.

One of the beveled edges 20 is positioned along the edge that intersects the right face 122 and the rear face 123 of the right member 132. Another beveled edge 20 is positioned along the edge that intersects the rear face 123 of the right member 132 and the right face 122 of the middle member 131. Another beveled edge 20 is positioned along the edge that intersects the right face 122 and the front face 121 of the right member 132. Another beveled edge 20 is positioned along the edge that intersects the front face 121 of the right member 132 and the right face 122 of the middle member 131.

The upper edge along the perimeter 60 of the top face 125 of the paving block unit (A) 100 is rounded edge. In other embodiments the upper edge along the perimeter 60 of the top face 125 of the paving block unit (A) 100 can be beveled or squared. The upper edge along the perimeter 60 helps direct fluid to flow vertically down into the spaces formed between adjacent paving block units as further described below.

Figure 2B:
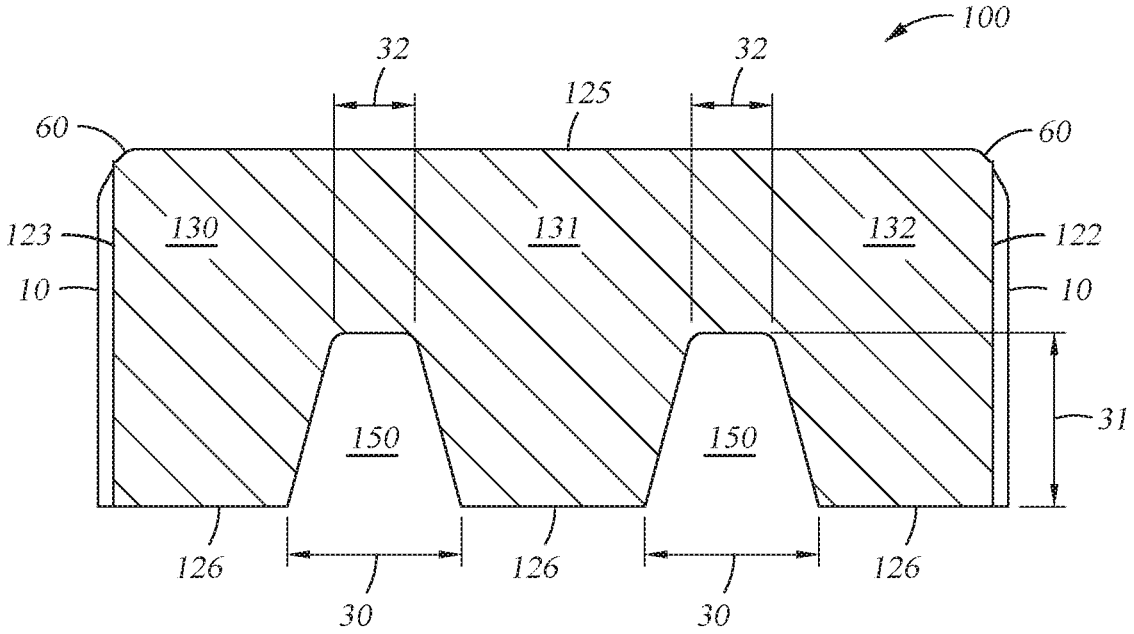
FIG. 2B is a cross sectional view along line 2B-2B of the paving block unit (A) shown in FIG. 2A.

FIG. 2B is a cross sectional view along line 2B-2B of the paving block unit (A) 100 shown in FIG. 2A. The cross section of the horizontal channels 150 is generally frustum shaped but can be of any other shape. The horizontal channels 150 are parallel to each other. In the embodiment shown in FIG. 2B the horizontal channels 150 comprise a height 31, a bottom width 30, and a top width 32. The height 31 can be within a range of 5 percent to 85 percent of the total height of the paving block unit (A) 100. The bottom width 30 can be within a range of 5 percent to 45 percent of the total length of the paving block unit (A) 100. The top width 32 can be within a range of 1 percent to 44 percent of the total length of the paving block unit (A) 100. The bottom width 30 is greater than the top width 32. In other embodiments the height 31, the bottom width 30, and the top width 32 of the horizontal channels 150 can be of different measurements, and the top width 32 could be greater or identical to the bottom width 30.

One horizontal channel 150 partially separates the left member 130 from the middle member 131. The other horizontal channel 150 partially separates the right member 132 from the middle member 132. The horizontal channels 150 on the paving block unit (A) 100 extend through the paving block unit (A) 100 from the front face 121 to the rear face 123. The horizontal channels 150 allow fluid to flow in a horizontal direction 310 beneath the paving block unit (A) 100. The horizontal direction 310 is better shown in FIG. 8.

In other embodiments there can be more than one middle member 131, thus creating more horizontal channels 150 between the left member 130 and the right member 132. Furthermore, the plurality of support members of the paving block unit (A) 100 are arranged such that the support members do not block the flow of fluid through the paving block unit (A) 100, and allow fluid flow into adjacent paving block units when interlocked into a paving block system. The dimensions of the height 31, the bottom width 30, the top width 32, and the depth of the horizontal channels 150 can be varied based upon the intended application.

Figure 2C:
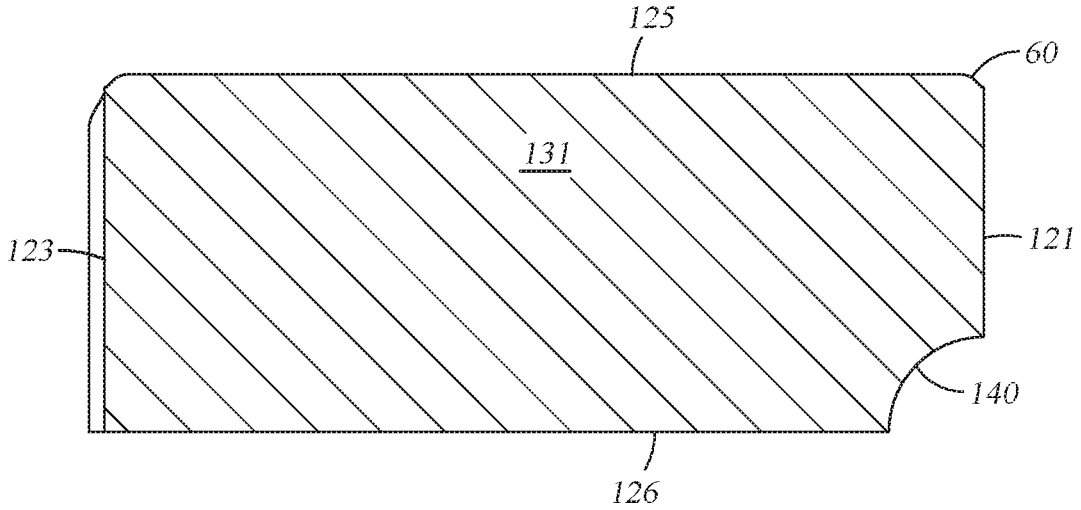
FIG. 2C is a cross sectional view along line 2C-2C of the paving block unit (A) shown in FIG. 2A.

FIG. 2C is a cross sectional view along line 2C-2C of the paving block unit (A) shown in FIG. 2A illustrating the notch 140. The notch 140 is formed along the edge where the middle member 131 comes in contact with the front face 121 and the bottom face 126. In this embodiment the notch 140 has a shape of an arch with radius that may be within any range such that the radius is less than the distance between the bottom face 126 and the top face 125. In other embodiments the notch 140 can be of any shape, for example a square, rectangle, or an angled edge. The notch 140 on the paving block unit (A) 100 allows fluid to be directed in a cross flow horizontal direction 320 between the horizontal channels 150. The cross flow horizontal direction 320 is better shown in FIG. 8. In other embodiments more than one notch 140 can be formed on the middle member 131, and/or included on the left member 130 and/or right member 132 for additional horizontal cross flow.

Figure 3:
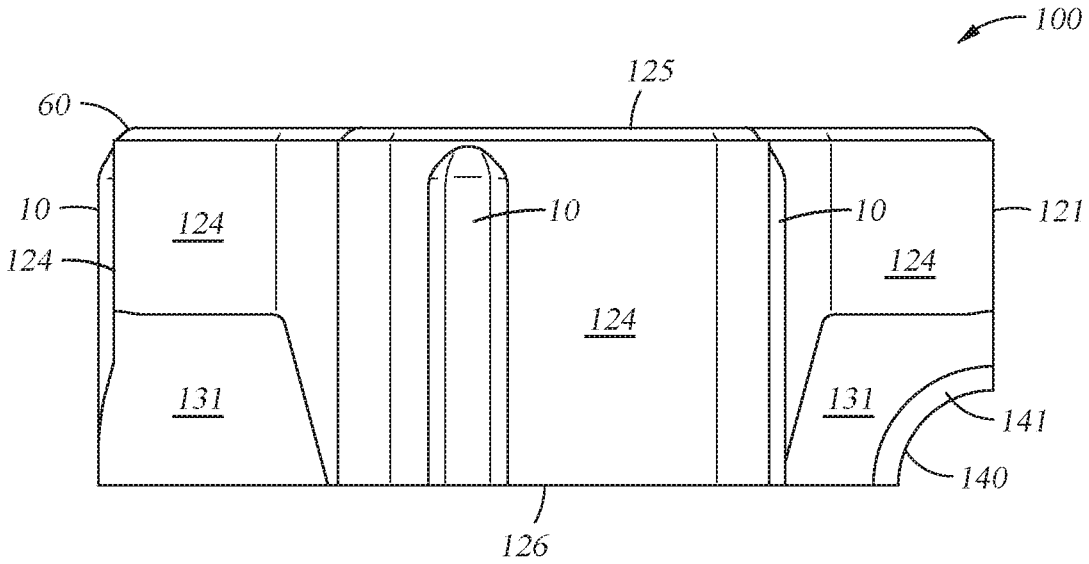
FIG. 3 is a side view of the paving block unit (A).

FIG. 3 illustrates a left side view of the paving block unit (A) 100 showing the left face 124 extending from the front face 121 to the rear face 123. The middle member 131 is also partially shown extending from the front face 121 to the rear face 123. The notch 140 on the middle member 131 is shown arching from the bottom face 126 to the front face 121. The notch 140 is shown with the rounded edges 141, but could have a beveled or straight edge. The spacers 10, which are discussed more in detail below, are also visible.

Figure 5:
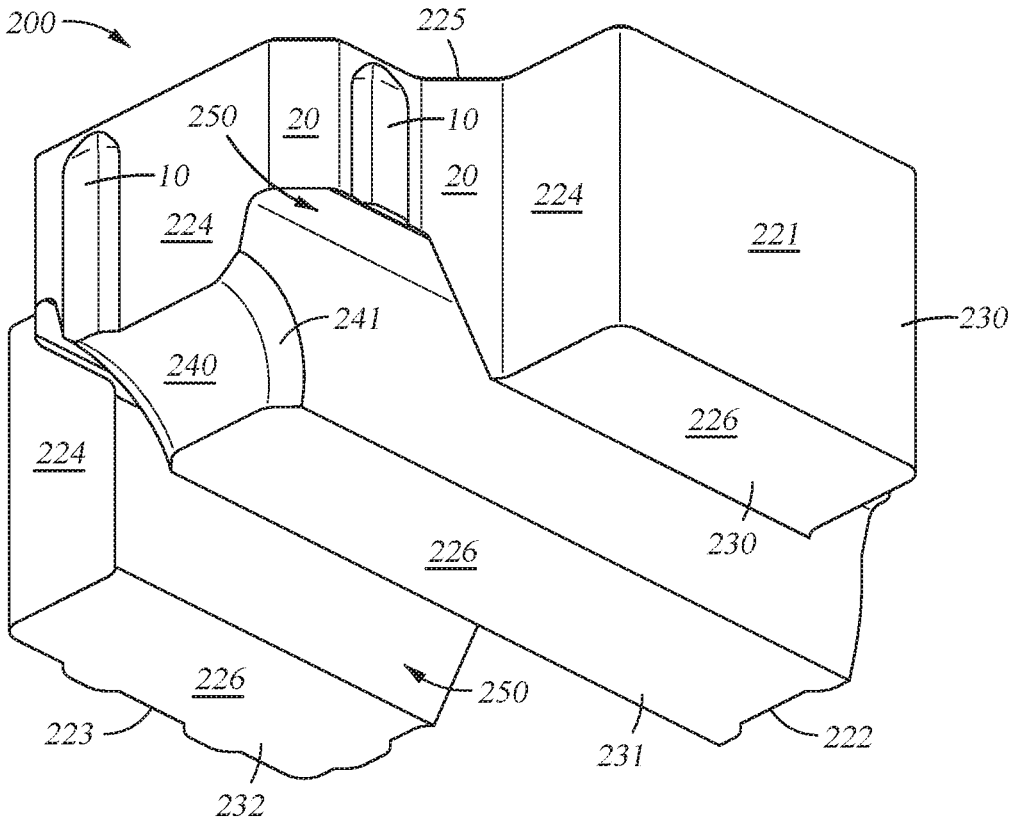
FIG. 5 is an isometric view of an embodiment of a paving block unit (B).

FIG. 5 is an isometric image of an embodiment of a paving block unit (B) 200. The paving block unit (B) 200 generally has a "cross" shape. The paving block unit (B) 200 comprises a front face 221 that extends from a left face 224 to a right face 222. The right face 222 extends from the front face 221 to a rear face 223. The rear face 223 extends from the right face 222 to the left face 223. The left face 224 extends from the rear face 223 to the front face 221. The paving block unit (B) 200 further comprises a top face 225 and a bottom face 226. A pair of horizontal channels 250 are formed along the bottom face 226, which separate the bottom face 226 into a front member 230, a middle member 231, and a rear member 232. A notch 240 having rounded edges 241 is formed along the edge of the middle member 231 where the left face 224 intersects the bottom face 226. Several spacers 10 are located along the sides of the paving block unit (B) 200 and are described in more detail below.

The front member 230, the middle member 231, and the rear member 232 extend from the bottom face 226 orthogonally towards the top face 225. The front member 230, the middle member 231, and the rear member 232 together form a plurality of support members that are arranged to allow the paving block unit (B) 200 to be placed upon the ground or a foundation such that the top face 225 of the paving block unit (B) 200 lies in a substantially horizontal plane.

Figure 6A:
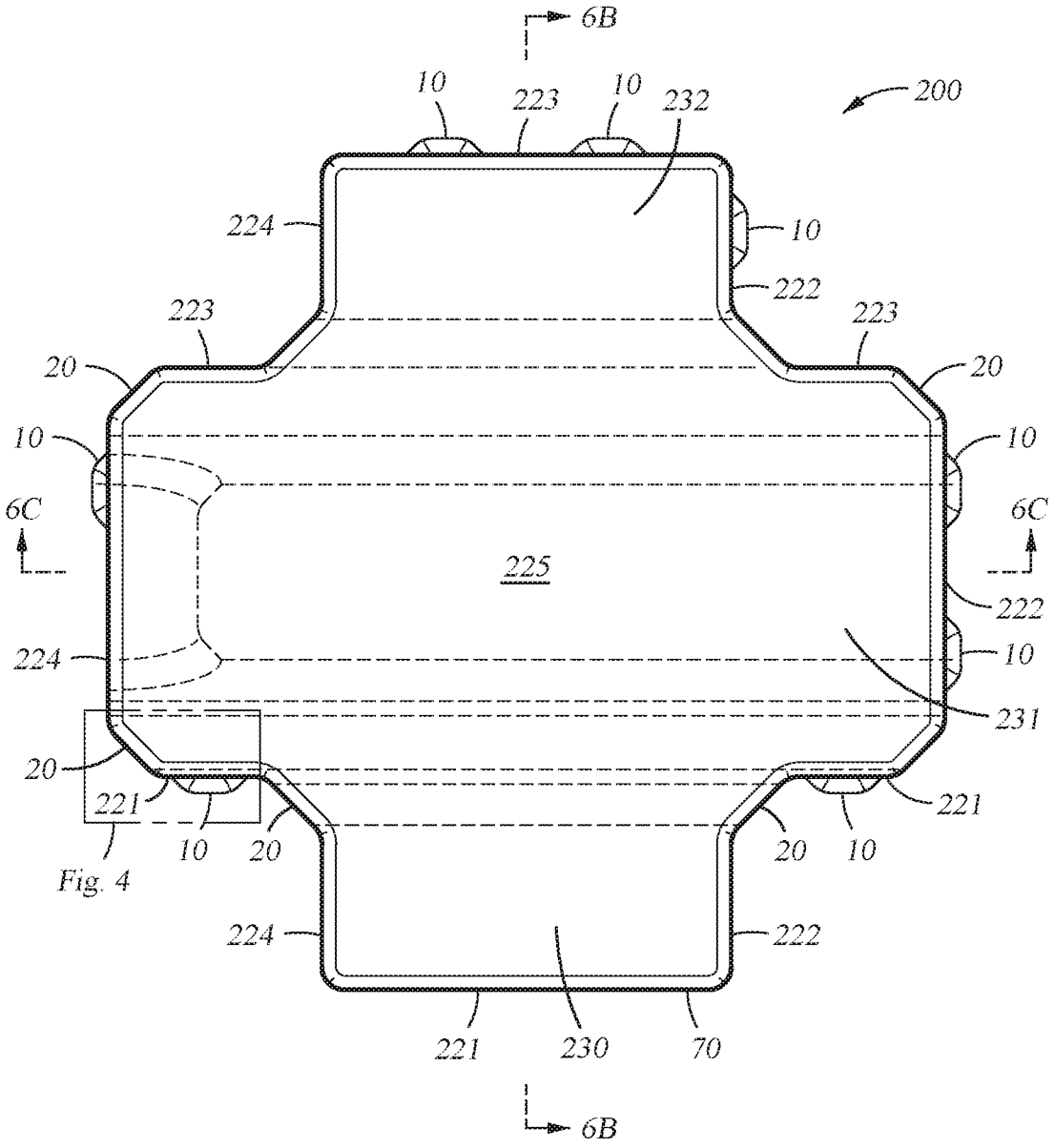
FIG. 6A is a top view of the paving block unit (B).

FIG. 6A is a top view of the paving block unit (B) 200. FIG. 6A better illustrates the "cross" shape of the paving block unit (B) 200. The paving block unit (B) 200 further comprises a plurality of beveled edges 20. The beveled edges can be of any angle. In other embodiments the beveled edges 20 can be rounded. The beveled edges 20 at the corners allow the paving block unit (B) 200 to properly mate with adjacent paving block units.

One of the beveled edges 20 is positioned along the edge that intersects the left face 224 and the rear face 223 of the middle member 231. Another beveled edge 20 is positioned along the edge that intersects the rear face 123 of the middle member 231 and the left face 224 of the rear member 232. Another beveled edge 20 positioned along the edge that intersects the left face 224 and the front face 221 of the middle member 231. Another beveled edge 20 positioned along the edge that intersects the front face 221 of the middle member 231 and the left face 224 of the front member 230.

One of the beveled edges 20 is positioned along the edge that intersects the right face 222 and the rear face 223 of the middle member 231. Another beveled edge 20 is positioned along the edge that intersects the rear face 223 of the middle member 231 and the right face 222 of the rear member 232. Another beveled edge 20 is positioned along the edge that intersects the right face 222 and front face 221 of the middle member 231. Another beveled edge 20 is positioned along the edge that intersects the front face 121 of the middle member 231 and the right face 222 of the front member 230.

The upper edge along the perimeter 70 of the top face 225 of the paving block unit (B) 200 has a rounded edge. In other embodiments the upper edge along the perimeter 70 of the top face 225 of the paving block unit (B) 200 can be beveled or squared. The upper edge along the perimeter 70 helps direct fluid to flow vertically down into the spaces formed between adjacent paving block units as further described below.

Figure 6B:
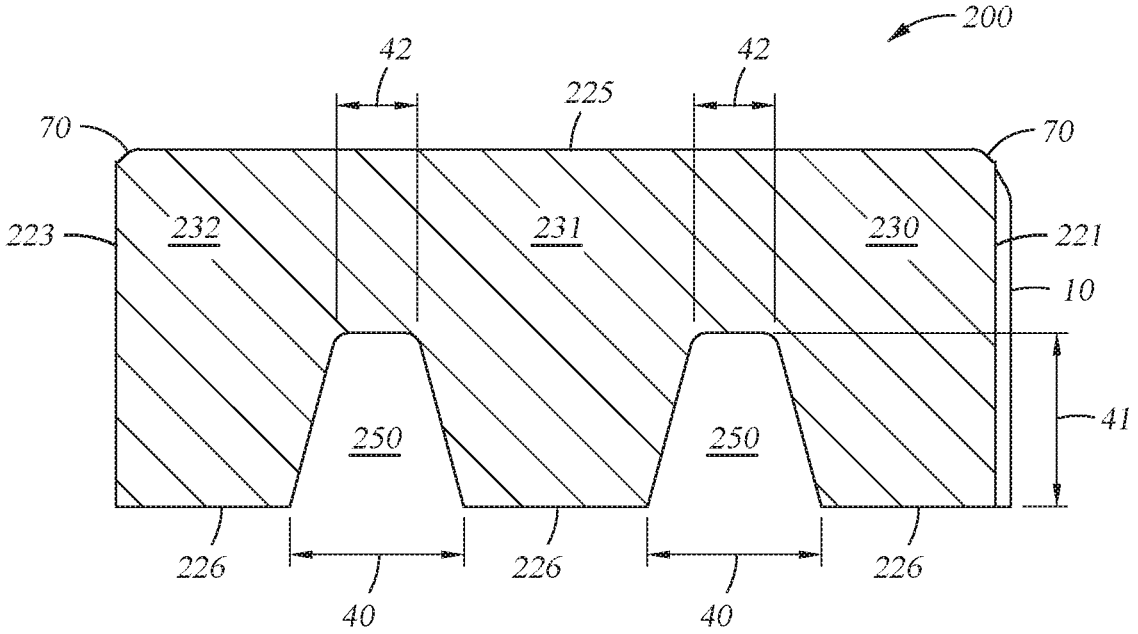
FIG. 6B is a cross sectional view along line 6B-6B of the paving block unit (B) shown in FIG. 6A.

FIG. 6B is a cross sectional view along line 6B-6B of the paving block unit (B) 200 shown in FIG. 6A. The cross section of the horizontal channels 250 is generally frustum shaped but can be of any other shape. The horizontal channels 250 are parallel to each other. In the embodiment shown in FIG. 6B the horizontal channels 250 comprise a height 41, a bottom width 40, and a top width 42. The height 41 can be within a range of 5 percent to 85 percent of the total height of the paving block unit (B) 200. The bottom width 40 can be within a range of 5 percent to 45 percent of the total length of the paving block unit (B) 200. The top width 42 can be within a range of 1 percent to 44 percent of the total length of the paving block unit (B) 200. The bottom width 40 is greater than the top width 42. In other embodiments the height 41, the bottom width 40, and the top width 42 of the horizontal channels 250 can be of different measurements, and the top width 42 could be greater or identical to the bottom width 40.

One horizontal channel 250 partially separates the front member 230 from the middle member 231. The other horizontal channel 250 partially separates the rear member 232 from the middle member 232. The horizontal channels 250 on the paving block unit (B) 200 extend through the paving block unit (B) 200 from the left face 224 to the right face 222. The horizontal channels 250 allow fluid to flow in a horizontal direction 320 beneath the paving block unit (B) 200. The horizontal direction 320 is better shown in FIG. 8.

In other embodiments there can be more than one middle member 231, thus creating more horizontal channels 250 between the front member 230 and the rear member 232. Furthermore, the plurality of support members of the paving block unit (B) 200 are arranged such that the support members do not block the flow of fluid through the paving block unit (B) 200, and allow fluid flow into adjacent paving block units when interlocked into a paving block system. The dimensions of the height 41, the bottom width 40, the top width 42, and the depth of the horizontal channels 250 can be varied based upon the intended application.

Figure 6C:
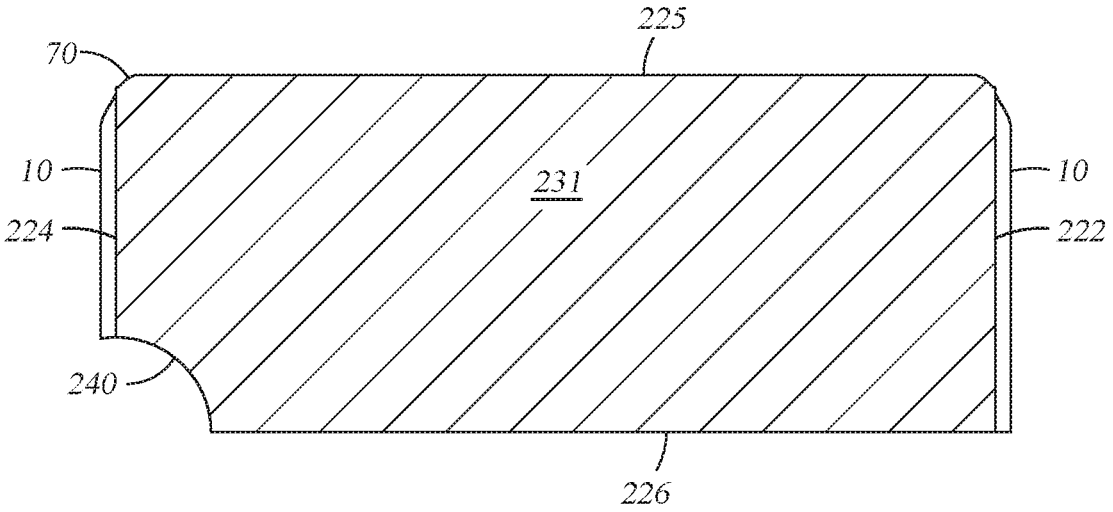
FIG. 6C is a cross sectional view along line 6C-6C of the paving block unit (B) shown in FIG. 6A.

FIG. 6C is a cross sectional view along line 6C-6C of the paving block unit (B) 200 shown in FIG. 6A illustrating the notch 240. The notch 240 is formed along the edge where the middle member 231 comes in contact with the left face 224 and the bottom face 226. In this embodiment the notch 240 has a shape of an arch with radius that may be within any range such that the radius is less than the distance between the bottom face 226 and the top face 225. In other embodiments the notch 240 can be of any shape, for example a square, rectangle, or an angled edge. The notch 240 on the paving block unit (B) 200 allows fluid to be directed in a cross flow horizontal direction 310 between the horizontal channels 250. The cross flow horizontal direction 310 is better shown in FIG. 8. In other embodiments more than one notch 240 can be on the middle member 231, and/or included on the front member 230 and/or the rear member 232 for additional horizontal cross flow.

Figure 7:
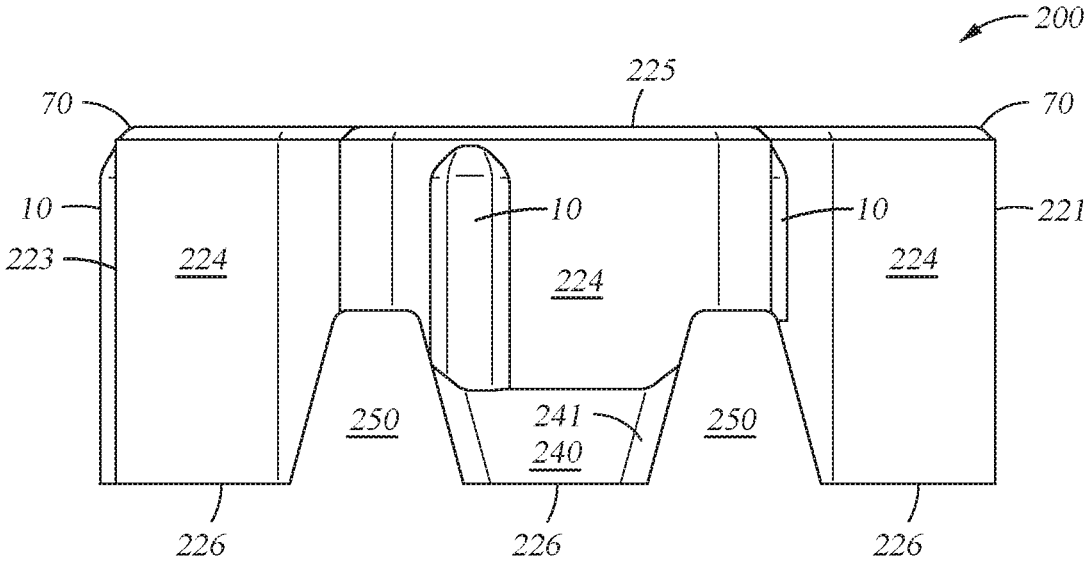
FIG. 7 is a side view of the paving block unit (B).

FIG. 7 illustrates a left side view of the paving block unit (B) 200 showing the left face 224 extending from the front face 221 to the rear face 223. The horizontal channels 250 are shown extending through the left face 224 across and through the right face 222 on the opposite side. The notch 240 is shown with the rounded edges 241, but could have a beveled or straight edge. The spacers 10, which are discussed more in detail below, are also visible.

Figure 4:
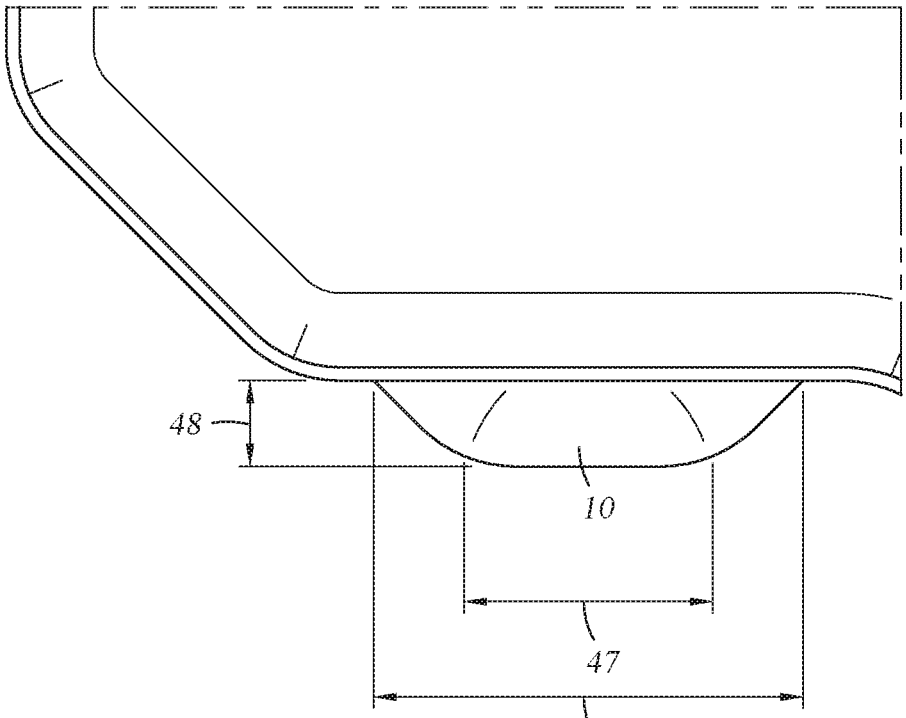
FIG. 4 is an enlarged view of a spacer according to one embodiment.

FIG. 4 is a close up view of a spacer 10 as shown in both FIG. 2A and FIG. 6A. The spacer 10 has a bottom width 46, a top width 47, and a height 48. The height 48, which is also the spacer off-set, can be within a range of 0.125 inches to 0.90 inches. The bottom width 46 can be within a range of 0.25 inches to 4 inches. The top width 47 can be within a range of 0.125 inches to 3.75 inches. The edges of the spacer 10 along the top width 47 are rounded. In other embodiments the edges can be beveled or straight. In other embodiments the spacer 10 can be of any other shape, for example squares, triangles, or any shape that will provide space between the adjacent paving block unit (A) 100 and/or the paving block unit (B) 200 when interlocked to form the paving block system. The spacers 10 at least partially extend from the bottom faces 126, 226 towards the top faces 125, 225, or at least partially extend from the top faces 125, 225 toward the bottom faces 126, 226, or both. In other embodiments the spacers 10 can partially extend from the left faces 121, 221 towards the rear faces 123, 223, or at least partially extend from the rear faces 123, 223 towards the left faces 121, 221, or both.

Multiple spacers 10 are located on the different side faces (e.g. rear, right, and left) of the paving block unit (A) 100 and the paving block unit (B) 200 as shown in FIGS. 2A and 6A, respectively. As shown, the positioning of the spacers 10 is identical on the paving block unit (A) 100 and the paving block unit (B) 200. The spacers 10 are used to space adjacent paving block units 100, 200 from each other to allow for fluid drainage vertically down the void created between adjacent paving block units (A) 100 and (B) 200, as well as to interlock the paving block units (A) 100 and (B) 200 together when assembled to form the paving block system. The spacers 10 are arranged asymmetrically to allow the paving block unit (A) 100 and the paving block unit (B) 200 to properly mate, while still providing a void between adjacent paving block units for fluid to drain vertically. It is contemplated that a symmetric shape could also be used to accomplish the same goal.

With respect to the paving block unit (A) 100 shown in FIG. 2A, there is one spacer 10 positioned on the front face 121 of the right member 132, and one spacer 10 positioned on the front face 121 of the left member 130. The right face 122 of the right member 132 comprises two spacers 10. The left face 124 of the left member 130 comprises one spacer 10. The rear face 123 of the middle member 131 comprises two spacers 10. The right face 122 of the middle member 131 comprises one spacer 10.

With respect to the paving block unit (B) 200 shown in FIG. 6A, there is one spacer 10 positioned on the front face 221 of the middle member 231 on the right side of the front member 230, and there is one spacer 10 positioned on the front face 221 of the middle member 231 on the left side of the front member 230. The right face 222 of the middle member 231 comprises two spacers 10. The left face 224 of the middle member 231 comprises one spacer 10. The rear face 223 of the rear member 232 comprises two spacers 10. The right face 222 of the rear member 232 comprises one spacer 10.

The paving block unit (A) 100 and the locations of the spacers 10 on the different sides of the paving block unit (A) 100 are identical to the paving block unit (B) 200 and the locations of the spacers 10 on the different sides of the paving block unit (B) 200, except that the horizontal channels 250 on the bottom face 226 of the paving block unit (B) 200 are oriented at a right angle (e.g. a 90 degree angle) relative to the horizontal channels 150 on the bottom face 126 of the paving block unit (A) 100. In other words, the horizontal channels 250 are perpendicular to the horizontal channels 150. Although shown as being oriented at a right angle relative to each other, the horizontal channels 250 may be oriented at any angle that is different than the angle at which the horizontal channels 150 are oriented when the paving block units (A) 100 and (B) 100 are interlocked together. The front face 121 of the middle member 131 of the paving block unit (A) 100 does not have any spacers 10. The front face 221 of the front member 230 of the paving block unit (B) 200 does not have any spacers 10.

Figure 8:
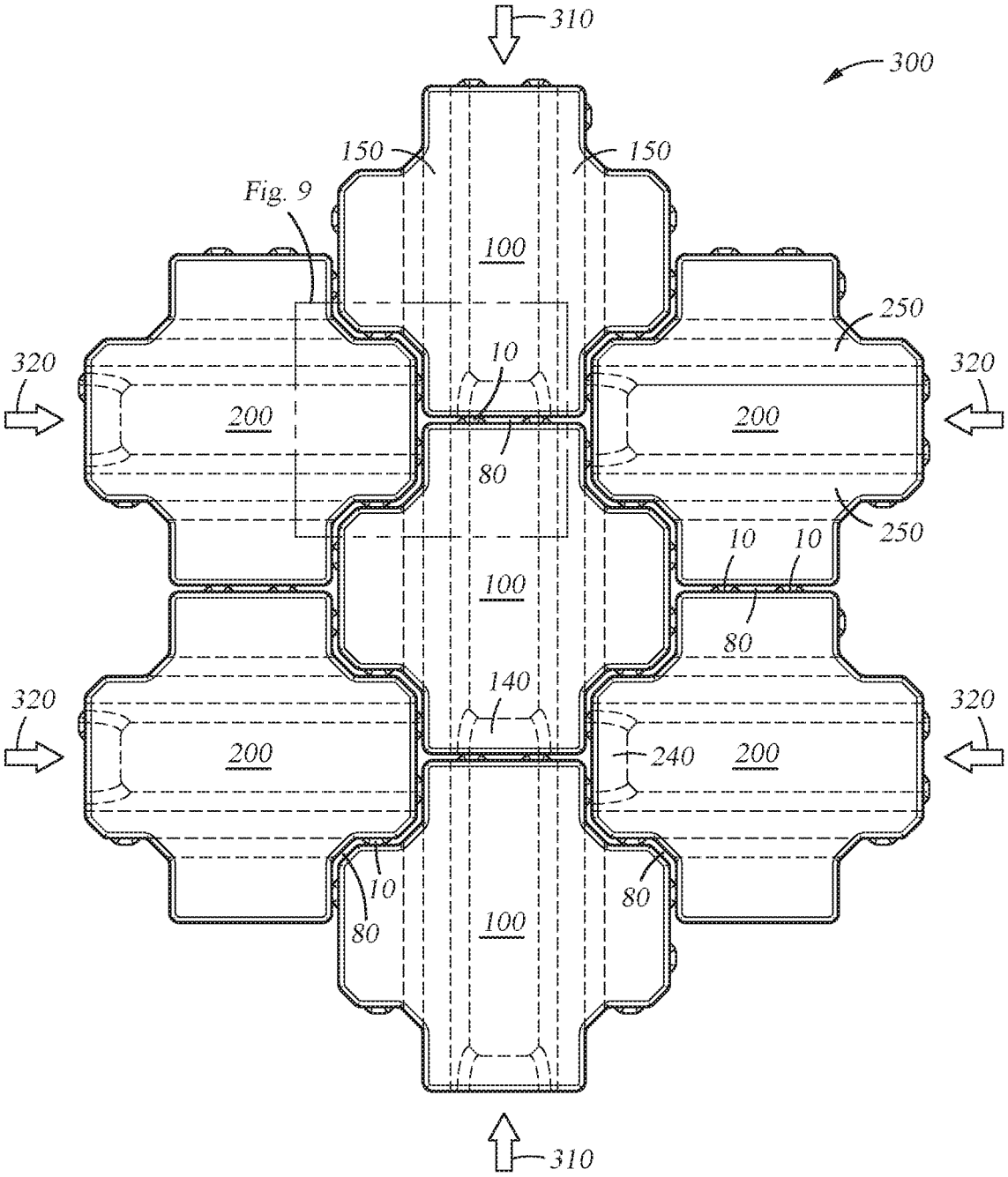
FIG. 8 is a top view of a paving block system.
Figure 9:
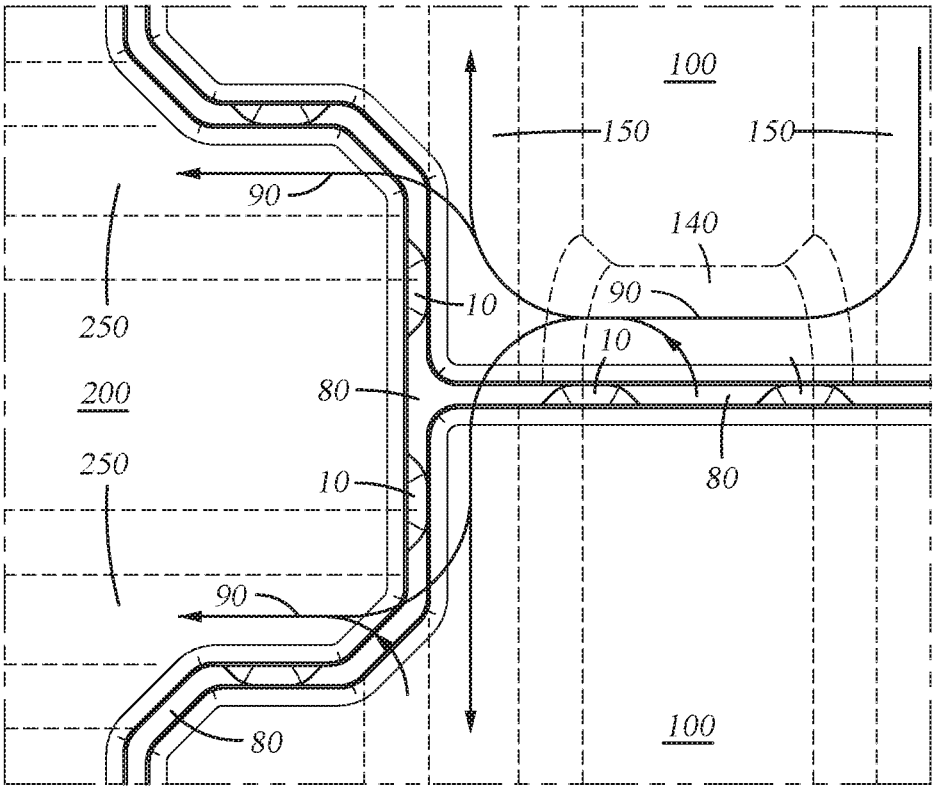
FIG. 9 is an enlarged view of a portion of the paving block system shown in FIG. 8.

FIG. 8 illustrates a plurality of paving block unit (A) 100 and paving block unit (B) 200 interlocked together to from a paving block system 300. FIG. 8 better illustrates the positioning of each spacer 10, allowing for all paving block unit (A) 100 and paving block unit (B) 200 to be interlocked adjacent to each other so that the spacers 10 do not overlap. One or more faces (or portions of faces) of at least one paving block unit (A) 100 contact one or more spacers 10 of at least one paving block unit (B) 200 when interlocked together. One or more faces (or portions of faces) of at least one paving block unit (B) 200 contact one or more spacers 10 of at least one paving block unit (A) 100 when interlocked together. The top faces 125, 225 of the paving block units (A) 100 and (B) 200 form a substantially flat, planar surface that lies in a horizontal plane when the paving block units (A) 100 and (B) 200 are interlocked. The spacers 10 provide a void 80 between adjacent paving block units (A) 100 and (B) 200 for fluid to flow down vertically into the horizontal channels 150, 250 of the respective paving block units (A) 100 and (B) 200. The horizontal channels 150 of the paving block unit (A) 100 are oriented perpendicular with respect to the horizontal channels 250 of the paving block unit (B) 200. The paving block units (A) 100 and (B) 200 are interlocked in a manner that fluid can also flow in any horizontal direction 310, 320 from front to back and from side to side through the horizontal channels 150, 250, as well as cross flow through the notches 140, 240. In other words, the paving block units (A) 100 and (B) 200 are interlocked with each other such that the channels 150, 250 and the grooves 140, 240 are in fluid communication with each other. FIG. 9 better illustrates the crossflow between the paving block units (A) 100 and (B) 200.

FIG. 9 is an enlarged view of a portion of the paving block system shown in FIG. 8. The spacers 10 create voids 80 between the paving block unit (A) 100 and the paving block unit (B) 200. The voids 80 can have a width within a range of 0.125 inches 0.90 inches. Fluids can crossflow across fluid channels 150, 250 through notches 140, 240 as indicated by reference arrows 90. The channels 150, 250 and the notches 140, 240 are in fluid communication with each other to allow fluid to flow from the top surface surfaces of the paving block units (A) 100 and/or (B) 200 in a vertical motion downward between the paving block units (e.g. through the voids 80), and then flow in a horizontal motion when the fluid reaches the underside of the paving block system 300 in one continuous unobstructed motion. The crossflow of fluid also allow for easy treatment and cleaning of the paving block system 300, particularly treatment and cleaning of the voids 80, the channels 150, 250, and the notches 140, 240. Treatment and cleaning can be administered throughout any of the voids 80 of the paving block system 300.

Figure 10:
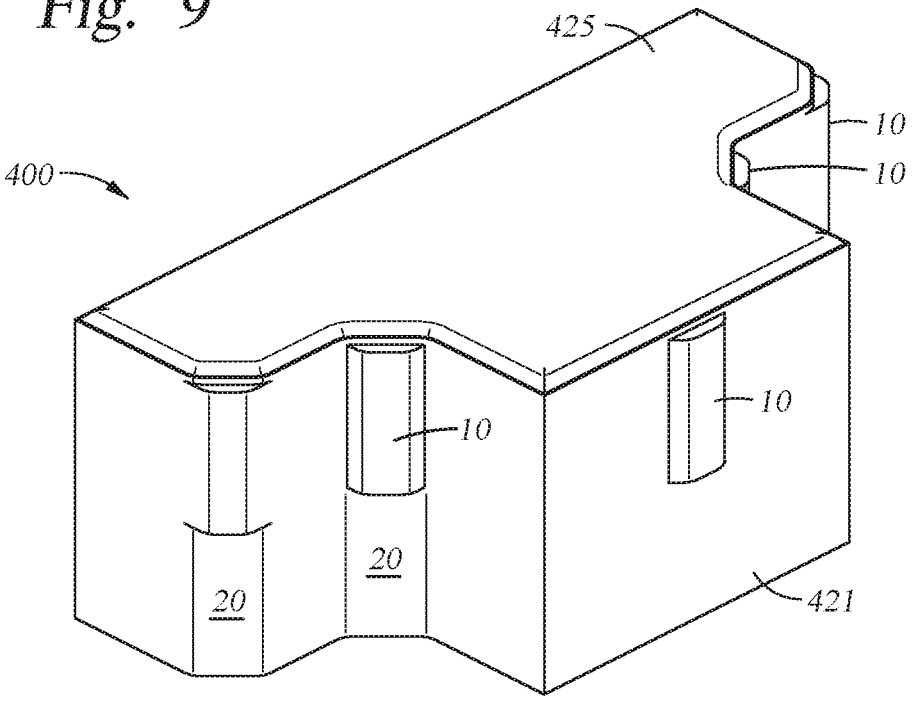
FIG. 10 is an isometric view of an embodiment of a half paving block unit.

FIG. 10 is an illustration of an embodiment of a half paving block 400. In the paving block system 300 shown in FIG. 8 the outside perimeter of the paving block system 300 is not straight. A half paving block unit 400 is able to fit adjacent to any outer side of the paving block system 300 to form a straight outer perimeter. The half paving block units 400 include one spacer 10 located on the front face 421, and spacers 10 located along the bevels 20. The spacers 10 are shown extending only half way down the thickness of the half paving block unit 400, but could alternatively extend the full thickness of the half paving block unit 400. A top face 425 of the half paving block unit 400 will lie in the same horizontal plane as the paving block system 300 when interlocked with the paving block units (A) 100 and/or (B) 200.

In other embodiments the shape of the paving block units 100, 200, 400 can be square, rectangles, or another type of design that can be interlocked with one or more other paving block units with the same or different design, to produce a paving block system which allows both vertical and horizontal fluid flow.

It is to be understood that the disclosure is not limited to particular embodiments as discussed herein and that it can be practiced, constructed, and/or carried out in various ways. While embodiments of the disclosure have been shown and described, modifications thereof can be made by one skilled in the art without departing from the spirit and teachings of the disclosure. The embodiment described herein are exemplary only, and are not intended to be limiting, but merely as a basis of the claims and as a representative basis for teaching persons having ordinary skill in the art to variously employ the embodiments. Many variations and modifications of embodiments disclosed herein are possible and are within the scope of the disclosure.

Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

The inclusion of discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

Accordingly, the scope of protection is not limited by the description herein, but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure.

The invention claimed is:

1. A paving block system, comprising;

a plurality of cross shaped paving block units (A) and a plurality of cross shaped paving block units (B) each comprising at least two parallel channels formed along a bottom face of the paving block units which separate the bottom face into a left member, a right member, and a middle member disposed between the left and right members, and a notch formed at one end of the middle member that provides cross flow between the channels, wherein the channels of the paving block units (A) are oriented perpendicular to the channels of the paving block units (B) when interlocked together, wherein the notch of each paving block unit (A) is located at an end of the middle member opposite from an end of the middle member that is closest to the notch of an adjacent paving block unit (A) when interlocked together, wherein the channels of the paving block units (A) are in fluid communication with the channels of the paving block units (B) when the paving block units are interlocked together to form the paving block system, wherein each paving block unit further comprises a plurality of spacers located on one or more sides of the paving block units to create voids between adjacent paving block units when the paving block units are interlocked together to allow fluid to flow freely along a vertical plane down the voids into the channels, and wherein the channels are in fluid communication with each other to allow fluid to flow freely in at least two perpendicular directions along a horizontal plane beneath the paving block units when interlocked together.

2. The system of claim 1, wherein the paving block units are shaped to interlock with each other without any additional securing mechanism.

3. The system of claim 1, wherein a bottom width of each channel is greater than a top width of each channel.

4. The system of claim 1, wherein the paving block units are interlocked with each other such that the spacers on one paving block unit do not overlap with the spacers on an adjacent paving block unit.

5. The system of claim 1, wherein the notch of each paving block unit (B) is located at an end of the middle member opposite from an end of the middle member that is closest to the notch of an adjacent paving block unit (B) when interlocked together.

6. The system of claim 1, wherein the spacers on the paving block unit (A) are located on the same relative sides as the spacers on the paving block unit (B).

7. The system of claim 1, wherein the paving block units are interlocked with each other such that the top faces of the paving block units form a flat planar surface.

8. The system of claim 3, wherein the channels and notches are in fluid communication with each other to allow fluid to flow horizontally from front to back and horizontally from right to left beneath the paving block units when interlocked together.

9. The system of claim 3, wherein the voids have a width within a range of 0.125 inches 0.90 inches.

10. A paving block system, comprising;

a plurality of cross shaped paving block units (A) and a plurality of cross shaped paving block units (B) each comprising at least two parallel channels formed along a bottom face of the paving block units which separate the bottom face into a left member, a right member, and a middle member disposed between the left and right members, and a notch formed in the middle member that provides cross flow between the channels, wherein the channels of the paving block units (A) are oriented perpendicular to the channels of the paving block units (B) when interlocked together, wherein each paving block unit further comprises a plurality of spacers located on one or more sides of the paving block units to create voids between adjacent paving block units when the paving block units are interlocked together to allow fluid to flow freely along a vertical plane down the voids into the channels and notches, wherein the spacers on the paving block unit (A) are located on the same relative sides as the spacers on the paving block unit (B), and wherein the channels and notches are in fluid communication with each other to allow fluid to flow freely in at least two perpendicular directions along a horizontal plane beneath the paving block units when interlocked together.

11. The system of claim 10, wherein a bottom width of each channel is greater than a top width of each channel.

12. The system of claim 10, wherein the paving block units are interlocked with each other such that the spacers on one paving block unit do not overlap with the spacers on an adjacent paving block unit.

13. The system of claim 10, wherein the notch of each paving block unit is in the shape of an arch.

14. The system of claim 10, wherein the voids have a width within a range of 0.125 inches 0.90 inches.

15. The system of claim 10, wherein the paving block units are interlocked with each other such that the top faces of the paving block units form a flat planar surface.

16. The system of claim 10, wherein the channels and notches are in fluid communication with each other to allow fluid to flow horizontally from front to back and horizontally from right to left beneath the paving block units when interlocked together.

17. The system of claim 10, wherein the notch of each paving block unit (A) is located at an end of the middle member opposite from an end of the middle member that is closest to the notch of an adjacent paving block unit (A) when interlocked together, and wherein the notch of each paving block unit (B) is located at an end of the middle member opposite from an end of the middle member that is closest to the notch of an adjacent paving block unit (B) when interlocked together.

18. A paving block system, comprising;

a plurality of cross shaped paving block units each comprising at least two parallel channels formed along a bottom face of the paving block units which separate the bottom face into a left member, a right member, and a middle member disposed between the left and right members, and a notch formed at one end of the middle member that provides cross flow between the channels, wherein the channels of at least one paving block unit are oriented perpendicular to the channels of at least one other paving block unit when interlocked together, wherein each paving block unit further comprises a plurality of spacers located on one or more sides of the paving block units to create voids between adjacent paving block units when the paving block units are interlocked together to allow fluid to flow into the channels and notches, and wherein the channels and notches are in fluid communication with each other to allow fluid to flow in at least two perpendicular directions along a horizontal plane beneath the paving block units when interlocked together for storage and drainage of fluid.

19. The system of claim 18, wherein the channels and notches are in fluid communication with each other to allow fluid to flow horizontally from front to back and horizontally from right to left beneath the paving block units when interlocked together.

20. The system of claim 18, wherein the channels and notches are in fluid communication with each other to allow fluid to flow from a top surface of the paving block units in a vertical motion downward between the paving block units, and then flow in a horizontal motion when the fluid reaches the underside of the paving block system in one continuous unobstructed motion.

* * * * *